United States Patent [19]

Kuzminski

[11] 4,429,028

[45] Jan. 31, 1984

[54] COLOR PICTURE TUBE HAVING IMPROVED SLIT TYPE SHADOW MASK AND METHOD OF MAKING SAME

[75] Inventor: Henry W. Kuzminski, Ephrata, Pa.

[73] Assignee: RCA Corporation, New York, N.Y.

[21] Appl. No.: 390,870

[22] Filed: Jun. 22, 1982

[51] Int. Cl.[3] ..... G03C 5/00

[52] U.S. Cl. ..... 430/5; 430/23; 430/321; 430/323; 430/396; 313/403; 313/408; 354/1; 445/47

[58] Field of Search ..... 430/4, 5, 23, 321, 323, 430/396; 313/403, 408, 453; 354/1; 29/25.17

[56] References Cited

U.S. PATENT DOCUMENTS

| | | | |
|---|---|---|---|
| 2,750,524 | 6/1956 | Braham | 313/86 |
| 2,863,079 | 12/1958 | Oestreicher | 313/85 |
| 2,922,073 | 1/1960 | Oestreicher | 315/21 |
| 3,199,430 | 8/1965 | Brown | 95/73 |
| 3,313,225 | 4/1967 | Mears | 95/75 |
| 3,574,013 | 4/1971 | Frantzen . | |
| 3,669,770 | 6/1972 | Feldstein | 156/3 |
| 3,674,488 | 7/1972 | Dodd et al. | 96/44 |
| 3,751,250 | 8/1973 | Moscony et al. | 96/36 |
| 3,834,905 | 9/1974 | Dodd et al. | 96/27 E |
| 4,061,529 | 12/1977 | Goldman et al. | 156/644 |
| 4,159,177 | 6/1979 | Elshot et al. | 355/133 |
| 4,168,450 | 9/1979 | Yamauchi et al. | 313/403 |
| 4,187,443 | 2/1980 | D'Amato et al. | 313/402 |
| 4,296,189 | 10/1981 | Kuzminski | 430/5 |
| 4,370,591 | 1/1983 | Satoh | 313/402 |

*Primary Examiner*—John E. Kittle
*Assistant Examiner*—José G. Dees
*Attorney, Agent, or Firm*—Eugene M. Whitacre; Dennis H. Irlbeck

[57] ABSTRACT

The photographic method utilized for fabricating slit-type shadow masks is improved by utilizing specially-shaped elements in a pattern on one of the photographic masters. In particular, the photographic master includes trapezoidal-shaped elements at locations away from the vicinity of the pattern minor axis, with the larger bases of the trapezoids facing away from the pattern minor axis.

4 Claims, 11 Drawing Figures

A
B
C
D
E
F
G
H
X
Y
50
52
54
56
58
60
62
64
64'
66
66'
68
68'
70
70'
72
72'
74
74'
75
76

COLOR PICTURE TUBE HAVING IMPROVED SLIT TYPE SHADOW MASK AND METHOD OF MAKING SAME

This invention relates to color picture tubes, particularly to such tubes having a slit type apertured mask and to a novel method for making such masks.

BACKGROUND OF THE INVENTION

Shadow mask type color picture tubes usually include a screen of red, green and blue-emitting phosphor lines or dots, an electron gun for exciting the screen, and a shadow mask interposed between the gun and the screen. The shadow mask is a thin multiapertured sheet of metal precisely disposed adjacent the screen so that the mask apertures are systematically related to the phosphor lines or dots.

Color picture tubes having shadow masks with slit shaped apertures have received relatively recent commercial acceptance. One of the reasons for this acceptance is that the electron beam transmission through the mask can be made higher for a slit-mask, line-screen type of tube than for a circular-apertured mask, dot-screen type tube. Even though the use of a slit mask provides a definite advantage in electron beam transmission, however, this transmission can be increased even further than is practiced in the present art.

In one type of slit shadow mask, the mask has vertically extending slit apertures which are interrupted by a plurality of spaced bridges or webs which provide mechanical rigidity. The presence of these webs, however, has an effect on electron beam transmission and thus on luminescent brightness. Such effect is greatest at the four corners of the mask, because the angles between the electron beams and a normal to the mask are greatest at the corners. With these greater angles, the electron beams strike not only the surfaces of the webs but also portions of the webs that form the ends of the slit apertures. Therefore, it is desirable to develop a mask fabrication technique which will produce a shadow mask wherein the parts of the electron beams striking the portions of the webs that form the ends of the slit apertures will be reduced or eliminated.

Shadow masks are fabricated from rolls of metal sheets, utilizing a photographic method. Such fabrication is disclosed in e.g., U.S. Pat. No. 2,750,524, issued to F. G. Braham on June 12, 1956; U.S. Pat. No. 3,199,430, issued to S. A. Brown on Aug. 10, 1965; U.S. Pat. No. 3,313,225, issued to N. B. Mears on Apr. 11, 1967; and U.S. Pat. No. 3,751,250, issued to J. J. Moscony et al. on Aug. 7, 1973. These patents are hereby incorporated by reference for the purpose of their disclosures of mask fabrication methods and related equipment.

The first step in the fabrication is to coat both sides of the metal sheet with a photosensitive material. Thereafter, the sides are photoexposed through two aligned photographic masters. Each photographic master has an array of elements corresponding to the apertures desired in the shadow mask. The elements of one master are larger than the elements of the other master so that the resultant mask apertures have larger openings facing the tube screen than facing the electron gun. Following exposure, the photosensitive material on the metal sheet is developed, and the photosensitive material at the areas corresponding to aperture locations is removed, thus exposing the metal sheet at these locations. Next, the metal sheet is etched to form apertures therethrough at the exposed locations. To obtain a desired aperture shape and a corresponding web shape, it is necessary to appropriately shape the pattern elements and position the corresponding elements of the two photographic masters.

SUMMARY OF THE INVENTION

In accordance with the invention, the photographic method utilized for fabricating slit-type shadow masks, such as previously described, is improved by utilizing specially-shaped elements in a pattern on one of the photographic masters. In particular, the photographic masters includes trapezoidal-shaped elements at locations away from the vicinity of the pattern minor axis, with the larger bases of the trapezoidal-shaped elements facing away from the pattern minor axis.

Use of the photographic master having the trapezoidal-shaped elements produces an improved shadow mask having increased electron beam transmission in off-axis locations of the mask.

DETAILED DESCRIPTION OF THE PREFERRED EMBODIMENT

Figure 1:
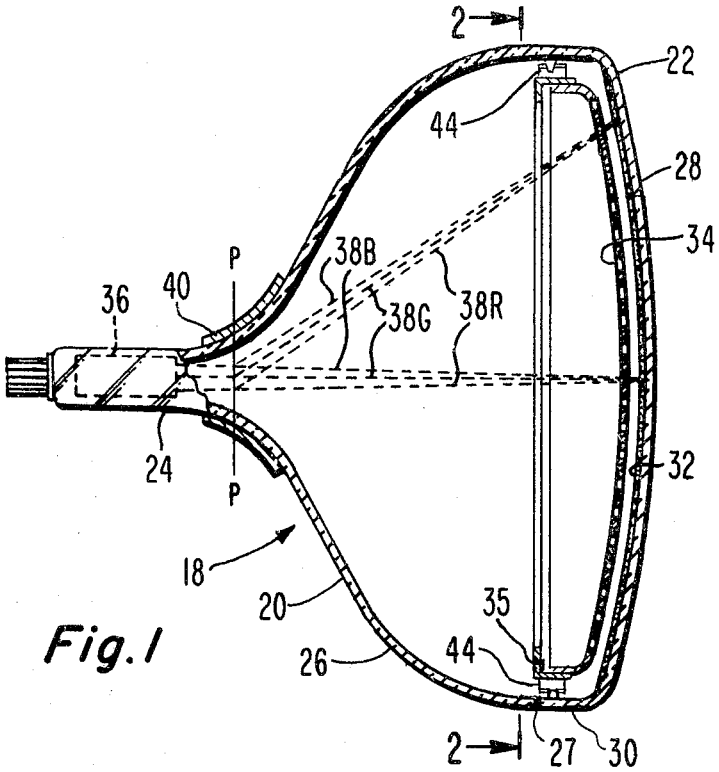
FIG. 1 is a plan view in axial section of an apertured mask cathode-ray tube.

FIG. 1 illustrates a rectangular color picture tube 18 having an evacuated glass envelope 20 comprising a faceplate panel 22 and a tubular neck 24 joined by a funnel 26. The panel 22 comprises a viewing faceplate 28 and a peripheral flange or sidewall 30, which is sealed to the funnel 26 by a frit material 27. A mosaic three-color cathodoluminescent line screen 32 is located on the inner surface of the faceplate 28. The screen 32 comprises an array of phosphor lines extending substantially parallel to the vertical axis of the tube. Portions of the screen 32 may be covered with a light absorbing material in a manner known in the art. A multiapertured color selection electrode or shadow mask 34, attached to a frame 35 having an L-shaped cross-section, is removably mounted within the panel 22 in predetermined space relationship to the screen 32. The mask 34 includes a multiplicity of slit-shaped apertures, which are aligned in substantially parallel vertical columns, and web portions separating the slits of each column.

An inline electron gun 36 (illustrated by a dashed rectangle) is mounted within the neck 24 to generate and direct three electron beams 38B, 38R, and 38G along coplanar convergent paths through the mask 34 to the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to vertical and horizontal magnetic fields that cause the beams to scan horizontally and vertically in a rectangular raster over the screeen 32. For simplicity, the actual curvature of the paths of the deflected beams in the deflection zone is not shown in FIG. 1. Instead, the beams are schematically shown as having an instantaneous bend at the plane of deflection P—P.

Figure 2:
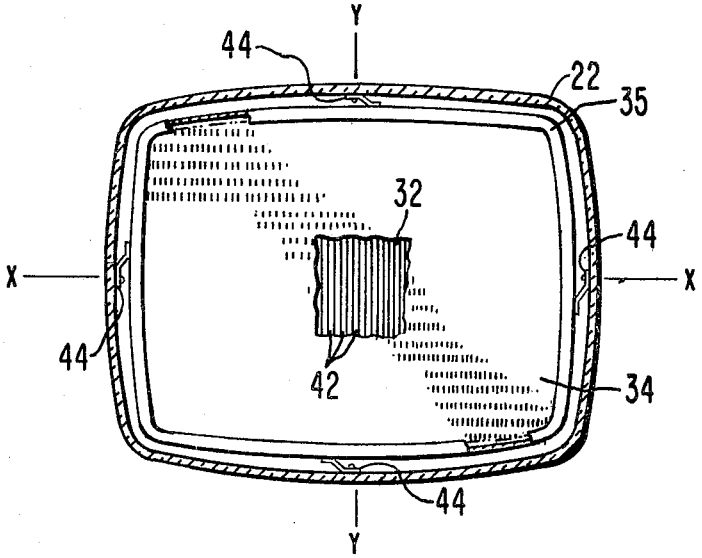
FIG. 2 is a back view of the faceplate and mask-frame assembly of the tube of FIG. 1, taken at line 2—2.

A portion of the screen 32, partially covered by the mask 34, is illustrated in FIG. 2. The screen 32 comprises alternate lines 42 of red, green and blue-emitting phosphor elements. Also shown in FIG. 2 are four mask-frame supports 44 (two of which are shown in FIG. 1) that suspend the assembly of the mask 34 and frame 35 within the panel 22. Although four supports 44 are used in this embodiment, other embodiments could use, for example, three supports.

Figures 3, 3A, 3B, 3C, 3D, 3E, 3F, 3G, 3H:
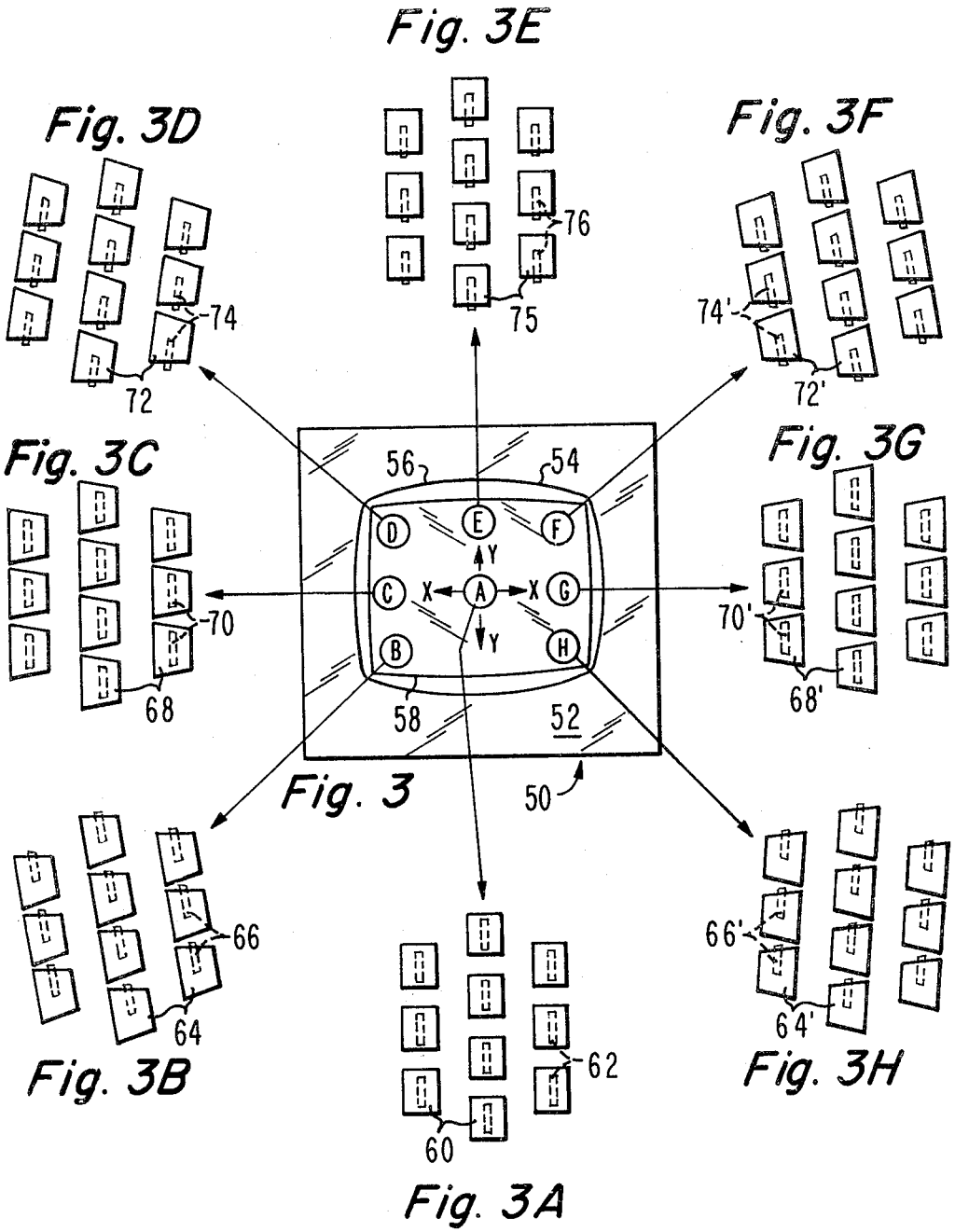
FIG. 3 is a plan view of a photographic master.
FIGS. 3A–3H are enlarged sections of the pattern of elements on the photographic master of FIG. 3 at locations A–H, respectively.

FIG. 3 shows a photographic master 50 used in exposing photosensitive material on a mctal sheet during fabrication of a shadow mask. The photographic master 50 comprises a glass plate 52 having a shadow mask pattern 54 thereon. The shadow mask pattern 54 includes an outer border 56 defining the distal edges of the mask skirt. An inner border 58 defines the limits of the apertured portion of the mask. The shapes of the pattern aperture elements at various locations designated A through H within the inner border 58 are shown in solid lines in FIGS. 3A through 3H, respectively. The dashed lines in FIGS. 3A through 3H represent the shapes of the pattern aperture elements on an aligned corresponding photographic master used for exposing the photosensitive material on the opposite side of the metal sheet.

Location A is at the center of the aperture pattern 54. As shown in FIG. 3A, the large elements 60, at location A of the aperture pattern, are rectangles. The small elements 62 of the aperture pattern on the opposite photographic plate are smaller rectangles vertically and horizontally centered with the large elements 60.

Location B is at the lower left hand corner of the aperture pattern 54. As shown in FIG. 3B, the large elements 64, at location B, are trapezoids with the large bases thereof facing away from the minor axis Y—Y. The small elements 66 on the opposite plate are smaller trapezoids horizontally centered with the large elements 64 but vertically shifted toward the major axis X—X.

Location C is on the major axis X—X at the left hand side of the aperture pattern 54. As shown in FIG. 3C, the large elements 68, at location C, are trapezoids. The small elements 70 on the opposite plate are smaller trapezoids vertically and horizontally centered with the large elements 68.

Location D is at the upper left hand corner of the aperture pattern 54. As shown in FIG. 3D, the large elements 72, at location D, are trapezoids with the large bases thereof facing away from the minor axis Y—Y. The small elements 74 on the opposite plate are smaller trapezoids horizontally centered with the large elements 72 but vertically shifted toward the major axis X—X.

Location E is near the upper edge of the aperture pattern 54 on the minor axis Y—Y. As shown in FIG. 3E, the large elements 75, at location E, are rectangles. The small elements 76 on the opposite plate are smaller rectangles horizontally centered with the large elements 75 but shifted toward the major axis X—X.

Locations F, G and H are at the upper right, right center and lower right of the aperture pattern 54, respectively. The pattern element shapes and orientations at these locations, as shown in FIGS. 3F, 3G and 3H, are mirror images about the minor axis Y—Y of the element shapes and orientations in FIGS. 3D, 3C and 3B, respectively. Corresponding elements are labeled with primes in these figures.

From FIGS. 3 and 3A through 3H, it can be seen that the photographic plate having the larger elements has trapezoidal-shaped elements at locations remote from the minor axis Y—Y, with the larger bases of the trapezoids facing away from the minor axis Y—Y. Near the minor axis Y—Y, the larger elements are rectangles. It also can be seen that the smaller elements on the opposite photographic plate are horizontally centered with the larger elements, but displaced toward the major axis X—X at locations displaced from the major axis X—X.

In an optimum aperture pattern on the large element photographic plate, the acute angles of the trapezoids are gradually decreased with increasing distance from the minor axis Y—Y. Unfortunately, the artwork for such gradual decrease is very difficult to achieve. Therefore, as a compromise, the central portion of the pattern near the minor axis is formed with rectangular large elements, and the right and left portions are formed with trapezoidal large elements of one size. Such size is determined by the most extreme case of electron beam angle in a completed tube. In a color picture tube embodiment having a 67 cm external diagonal and maximum deflection of 110 degrees, the internal angles of the trapezoidal elements are 87.5 degrees and 92.5 degrees. The calculated gain in electron beam transmission at the corners of the tube, utilizing the present invention, is 3.4 percent with the transmission going from 19 percent without the invention to 19.65 percent using the invention.

The foregoing artwork can be achieved utilizing known methods and materials. Such methods and materials are disclosed in, e.g., U.S. Pat. No. 3,669,770, issued to N. Feldstein on June 13, 1972; U.S. Pat. No. 3,674,488, issued to J. A. Dodd, Jr., et al. on July 4, 1972; U.S. Pat. No. 3,834,905, issued to J. A. Dodd, Jr., et al. on Sept. 10, 1974; and U.S. Pat. No. 4,061,529, issued to A. Goldman, et al. on Dec. 6, 1977. These patents are hereby incorporated by reference for the purpose of their disclosures of artwork fabrication and materials.

What is claimed is:

1. In a method of fabricating a slit-type shadow mask for a color picture tube, wherein the method includes coating both sides of a metal sheet with a photosensitive material, photoexposing the photosensitive material on both sides of the metal sheet through two aligned photographic masters having aperture patterns thereon, said aperture patterns including major and minor axes, developing the photosensitive material and etching apertures in said metal sheet, the improvement comprising the aperture pattern on a first of said photographic plates including trapezoidal-shaped elements at locations away from the vicinity of the pattern minor axis, with the longer bases of the trapezoidal-shaped elements facing away from the minor axis.

2. The method as defined in claim 1, wherein the aperture pattern on a second of said photographic plates includes smaller elongated elements at locations corresponding to the locations of said trapezoidal-shaped elements, the centers of the smaller elongated elements away from the vicinity of the pattern major axis being closer to the pattern major axis than are the centers of the corresponding trapezoidal-shaped elements on said first photographic plate.

3. The method as defined in claim 2, wherein said smaller elongated elements also are trapezoidally-shaped.

4. A shadow mask constructed in accordance with the method of claims 1, 2 or 3.

* * * * *